US007100794B2

(12) United States Patent
Sakamoto

(10) Patent No.: US 7,100,794 B2
(45) Date of Patent: Sep. 5, 2006

(54) PAPER CONTAINER

(75) Inventor: Yuzo Sakamoto, Saitama-ken (JP)

(73) Assignee: Sakamoto Steel Ruledie, Inc., Saitama-ken (JP)

( * ) Notice: Subject to any disclaimer, the term of this patent is extended or adjusted under 35 U.S.C. 154(b) by 104 days.

(21) Appl. No.: 10/797,134

(22) Filed: Mar. 11, 2004

(65) Prior Publication Data

US 2004/0178211 A1 Sep. 16, 2004

(30) Foreign Application Priority Data

Mar. 12, 2003 (JP) ..... 2003-067221

(51) Int. Cl.
*B65H 1/00* (2006.01)

(52) U.S. Cl. ..... 221/63; 221/33

(58) Field of Classification Search ..... 221/63, 221/45, 305, 307, 303, 33, 34, 37, 38, 247, 221/240, 260, 23; 206/233, 518; 248/905; 225/39, 52, 93, 106
See application file for complete search history.

(56) References Cited

U.S. PATENT DOCUMENTS 2,323,395 A * 7/1943 Harwood ..... 221/48
4,589,630 A * 5/1986 Arzouman ..... 254/7 B
4,653,666 A * 3/1987 Mertens ..... 221/45
4,785,970 A * 11/1988 Engelmayer ..... 221/47
6,135,842 A * 10/2000 LaFata ..... 446/15

FOREIGN PATENT DOCUMENTS

JP 2002-2836 1/2002

* cited by examiner

*Primary Examiner*—Gene O. Crawford
*Assistant Examiner*—Timothy Waggoner
(74) *Attorney, Agent, or Firm*—Wenderoth, Lind & Ponack, L.L.P.

(57) ABSTRACT

A paper container comprises: a container main body in the form of a rectangular parallelepiped that accommodates a number of papers or the like, such as tissue papers, that are placed one upon another, being folded; and an opening portion which is formed on a top of the container main body, wherein respective cuts 5 for a pair of up and down movable flaps 3*a*, 3*b*, and pairs of side flaps 4*a*, 4*b*, 4*c*, 4*d* are formed with a waved blade (corrugated) cutting tool whose blade portion has a pitch of 0.1 to 3.0 mm.

20 Claims, 4 Drawing Sheets

PAPER CONTAINER

FIELD OF THE INVENTION

The present invention relates to a paper container for accommodating a number of papers or the like, such as tissue papers, that are placed one upon another, being folded, and are successively removed from the paper container.

BACKGROUND OF THE INVENTION

Conventionally, as a paper container for accommodating a number of papers or the like, such as tissue papers, that are placed one upon another, being folded, a paper container as disclosed in Patent Documents 1, for example, has been proposed.

With the container for tissue papers as disclosed in the Patent Documents 1, an opening portion is provided in a top wall of the container, and a plastic film is attached to the opening portion for closing it, with the film being provided with perforations for removing a tissue paper.

However, the container for tissue papers as disclosed in Patent Documents 1 is configured such that a plastic film is attached to the opening portion, and thus, in manufacturing, there is a need for preparing the plastic film, and attaching it to the opening portion, which increases manufacturing cost, and when the container for tissue papers is to be discarded as a used one, the plastic film must be peeled from the container for tissue papers, sorted, and discarded, from a viewpoint of environmental protection; therefore a problem of a user being requested to make extra work arises.

Patent Documents 1

Patent Publication No. JP/P2002-002836A

Having been developed in consideration of this conventional situation, the present invention eliminates a need for using a plastic film, which is used with the above-mentioned conventional container for tissue papers, and is intended to provide a paper container comprising a high-performance opening portion which offers excellent operability in removing a paper or the like, such as a tissue paper, and yet eliminates a possibility of a user's fingers being accidentally injured in removing the paper or the like, such as a tissue paper, in opening or unsealing the paper container, and that of the paper or the like, such as tissue paper, being damaged when it is removed from the paper container.

SUMMARY OF THE INVENTION

The paper container in accordance with a first aspect of the invention provides a paper container comprising: a container main body for accommodating a number of papers or the like, such as tissue papers, that are placed one upon another, being folded; and an opening portion for removing the paper or the like that is formed by cutting a part of a top of the container main body, wherein a cut constituting the opening portion is formed with a waved blade (corrugated) cutting tool whose blade portion has a pitch of 0.1 mm to 3.0 mm.

The paper container in accordance with a second aspect of the invention provides a paper container comprising: a container main body for accommodating a number of papers or the like, such as tissue papers, that are placed one upon another, being folded; and an opening portion for removing the paper or the like that is formed by cutting a part of a top of the container main body, wherein a cut constituting the opening portion is formed with a waved blade (corrugated) cutting tool whose blade portion has a pitch of 0.1 mm.

The paper container in accordance with a third aspect of the invention provides a paper container comprising: a container main body in the form of a rectangular parallelepiped that accommodates a number of papers or the like, such as tissue papers, that are placed one upon another, being folded; and an opening portion for removing the paper or the like that is formed by cutting a part of a top of the container main body, wherein the opening portion is composed of: a pair of up and down movable flaps which are formed around a cut in a middle area; a pair of creases which are formed at rear ends of the pair of up and down movable flaps, i.e., in areas opposite to the cut in the middle area; and cuts which are formed by connecting right and left ends of the cut in the middle area with right and left ends of the pair of creases, and respective cuts constituting the opening portion are formed with a waved blade (corrugated) cutting tool whose blade portion has a pitch of 0.1 mm to 3.0 mm.

The paper container in accordance with a fourth aspect of the invention provides a paper container comprising: a container main body in the form of a rectangular parallelepiped that accommodates a number of papers or the like, such as tissue papers, that are placed one upon another, being folded; and an opening portion for removing the paper or the like that is formed by cutting a part of a top of the container main body, wherein the opening portion is composed of a pair of up and down movable flaps which are formed around a cut in a middle area; a pair of creases which are formed at rear ends of the pair of up and down movable flaps, i.e., in areas opposite to the cut in the middle area; and cuts which are formed by connecting right and left ends of the cut in the middle area with right and left ends of the pair of creases, and respective cuts constituting the opening portion is formed with a waved blade (corrugated) cutting tool whose blade portion has a pitch of 0.1 mm.

The paper container in accordance with a fifth aspect of the invention provides a paper container comprising:

a container main body in the form of a rectangular parallelepiped that accommodates a number of papers or the like, such as tissue papers, that are placed one upon another, being folded; and an opening portion for removing the paper or the like that is formed approximately rectangularly as a whole on a top of the container main body, and is comprised of a pair of up and down movable, central flaps for removing paper or the like, and pairs of side flaps which are formed symmetrically on both sides of the up and down movable flaps, with a cut being formed by cutting between the pair of up and down movable flaps; between respective pairs of side flaps; between the up and down movable flaps and the side flaps; and between a side edge of the side flaps and an upper face forming a top of the container main body, and a crease being formed at respective rear ends of the pair of up and down movable flaps and the pairs of side flaps, wherein respective cuts constituting the opening portion are formed with a waved blade (corrugated) cutting tool whose blade portion has a pitch of 0.1 mm to 3.0 mm.

The paper container in accordance with a sixth aspect of the invention provides a paper container comprising:

a container main body in the form of a rectangular parallelepiped that accommodates a number of papers or the like, such as tissue papers, that are placed one upon another, being folded; and an opening portion for removing the paper or the like that is formed approximately rectangularly as a whole on a top of the container main body, and is comprised of a pair of up and down movable, central flaps for removing the paper or the like, and pairs of side flaps which are formed symmetrically on both sides of the up and down movable flaps, with a cut being formed by cutting between the pair of up and down movable flaps; between respective pairs of side flaps; between the up and down movable flaps and the side flaps; and between a side edge of the side flaps and an upper face forming a top of the container main body, and a crease being formed at respective rear ends of the pair of up and down movable flaps, and the pairs of side flaps, wherein respective cuts constituting the opening portion are formed with a waved blade (corrugated) cutting tool whose blade portion has a pitch of 0.1 mm.

According to the present invention, respective cuts for the up and down movable flaps constituting the opening portion, and respective cuts between the up and down movable flaps and the side flaps are provided with a waved blade or corrugated geometry which has a pitch of 0.1 to 3.0 mm, preferably, 0.1 mm, and thus, various high-performance paper containers can be provided which assure operability in removing a paper or the like, such as a tissue paper, ability for the up and down movable flaps and the side flaps to hold a paper or the like, and sanitation based on a covering function of the side flaps, and eliminate a possibility of a user's fingers being accidentally injured in removing a paper or the like, such as a tissue paper, in opening or unsealing the paper container, and that of the paper or the like, such as a tissue paper, being damaged when it is removed from the paper container.

In addition, a need for attaching a plastic film to the opening portion, as with the conventional art is eliminated, which can reduce manufacturing cost, simplify operation of a user in disposal of the paper container, and yet provide a paper container which is environmentally-conscious.

DESCRIPTION OF THE PREFERRED EMBODIMENT

Here is a description of an embodiment of the present invention, but the present invention is not limited to this embodiment.

Figure 1:
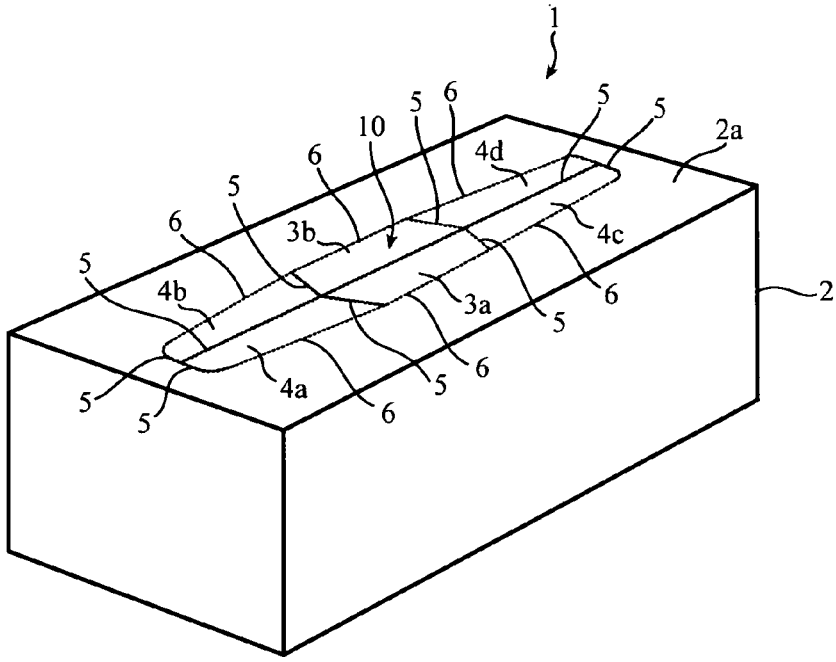
FIG. 1 is a perspective view showing an appearance of a paper container according to an embodiment of the present invention.
Figure 2:
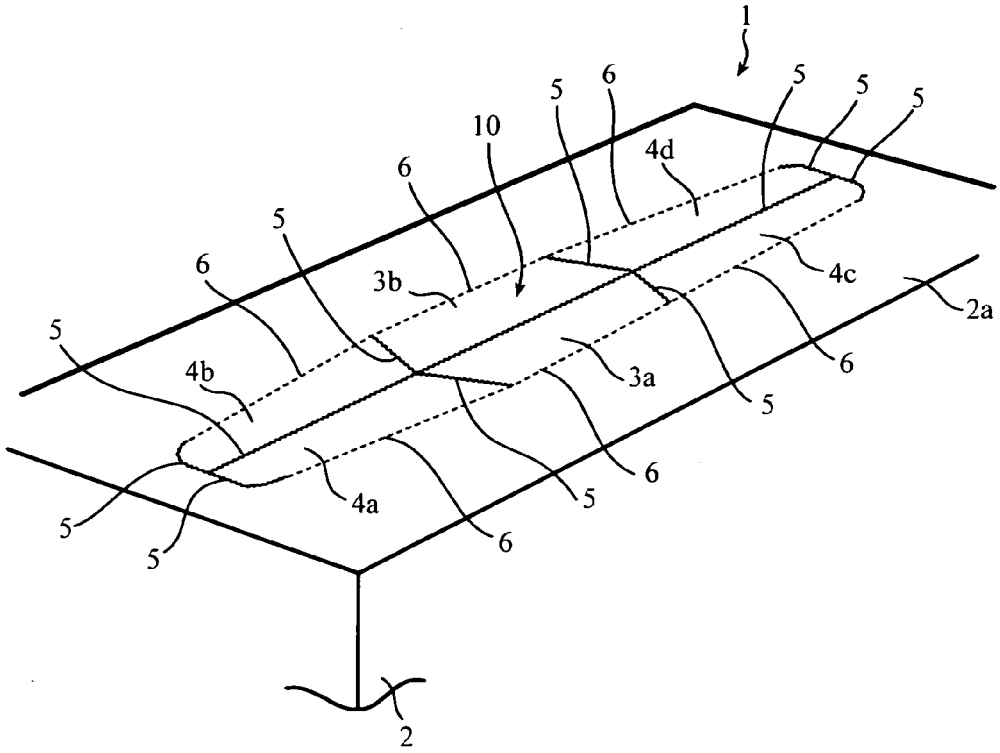
FIG. 2 is a partially enlarged perspective view of the paper container according to the embodiment of the present invention.
Figure 5:
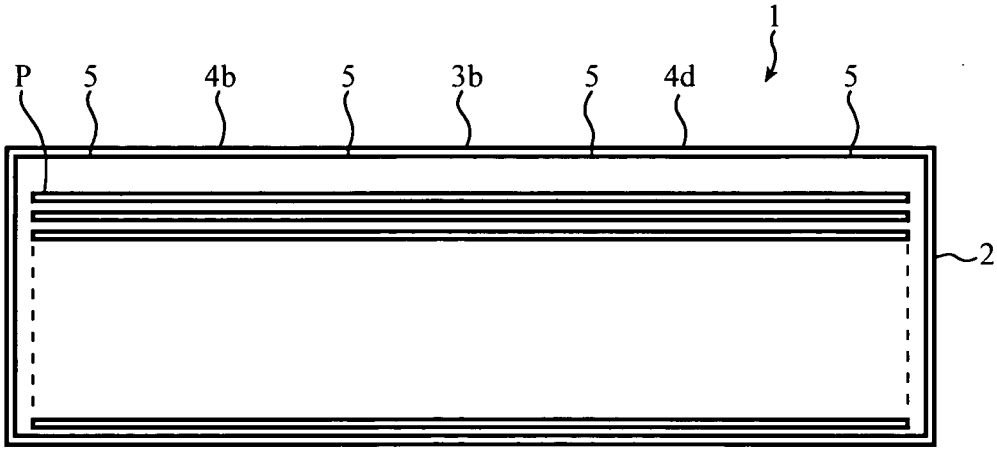
FIG. 5 is a sectional view showing a condition before starting use of the paper container according to the embodiment of the present invention.

FIG. 1 is a perspective view showing an appearance of a paper container 1 according to one embodiment of the present invention, and the paper container 1 comprises a container main body 2 in the form of a rectangular parallelepiped that can accommodate a number of papers or the like P (see FIG. 5), such as tissue papers, that are placed one upon another, being folded; and an opening portion 10 for removing the paper or the like P, that is formed approximately rectangularly as a whole on a top of the container main body 2, and is comprised of a pair of up and down movable, central flaps 3*a*, 3*b* for removing paper or the like P, and pairs of side flaps 4*a*, 4*b*, 4*c*, 4*d* which are formed symmetrically on both sides of the up and down movable flaps 3*a*, 3*b*. As shown in FIG. 2, being enlarged, the opening portion 10 is configured by forming cuts 5 by cutting between the pair of up and down movable flaps 3*a*, 3*b*; between respective pairs of side flaps 4*a*, 4*b*, 4*c*, 4*d*; between the up and down movable flap 3*a*, 3*b* and the side flaps 4*a*, 4*b*, 4*c*, 4*d*; and further between a side edge of the side flaps 4*a*, 4*b*, the side flaps 4*c*, 4*d*, and an upper face 2*a* forming the top of the container main body 2, and a crease 6 as shown with a dotted line at respective rear ends of the pair of up and down movable flaps 3*a*, 3*b* and the pairs of side flaps 4*a*, 4*b*, 4*c*, 4*d*.

Figure 3:
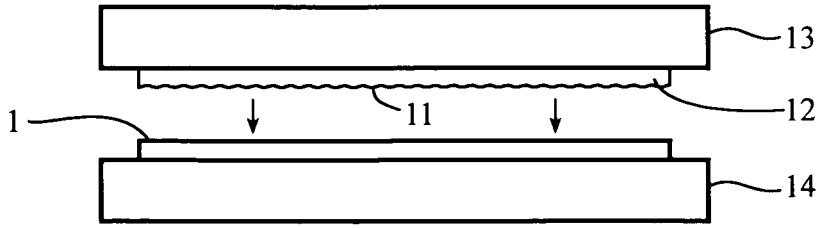
FIG. 3 is a schematic drawing showing a punching die for forming a cut in the paper container according to the embodiment of the present invention.
Figure 4:
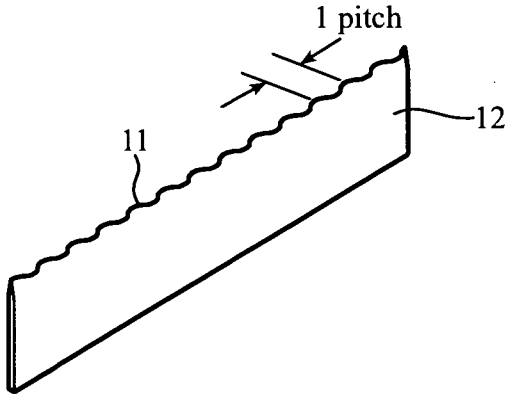
FIG. 4 is a perspective view showing a waved blade cutting tool for forming a cut in the paper container according to the embodiment of the present invention.

As shown in FIG. 3 and FIG. 4, respective cuts 5 which constitute the opening portion 10 are created through a cutting process with forming dies that involves mounting a waved blade (corrugated) cutting tool 12, whose blade portion 11 has a pitch of 0.1 to 3.0 mm, preferably, 0.1 mm, to an upper die 13; loading the paper container 1 before assembling on a lower die 14; and dropping the upper die 13 toward the lower die 14.

As a result of this, the respective cuts 5 are provided with a minute blade geometry which has a pitch of 0.1 to 3.0 mm, preferably, 0.1 mm, corresponding to the blade portion 11 of the waved blade cutting tool 12. In other words, the cuts define opposing corrugated edges including crests and valleys with a pitch between adjacent crests being within a range of from 0.1 mm to 3.0 mm.

Reasons why the respective cuts 5 are provided with a minute blade geometry which has a pitch of 0.1 to 3.0 mm, preferably, 0.1 mm, are a necessity of assuring ease of opening; preventing fingers from being injured in removing paper or the like P by operating the fingers; providing a sufficient capability of holding the paper or the like P; and avoiding removed paper or the like P from being damaged when being contacted and engaged with the cuts.

In other words, if the cuts 5 are provided with a minute blade geometry which has a pitch of under 0.1 mm, a capability of holding the paper or the like P for preventing it from being dropped will be insufficient, and contrarily, if the pitch exceeds 3.0 mm, a degree of engagement of the cuts with the removed paper or the like P, and resulting damage thereto, will be too high.

The creases 6 are formed by perforation, cutting with a reed, waved, or straight blade, scoring, or the like.

With the present invention, as a modification of the paper container 1 according to the embodiment as shown in FIG. 1, the paper container 1 may be composed of a container body 2, and an opening portion 10 for removing paper or the like P, formed on a top of the container body 2. The opening portion 10 may be composed of a pair of up and down movable flaps 3*a*, 3*b* which are formed around a cut 5 in a middle area; a pair of creases 6, 6 which are formed at rear ends of the pair of up and down movable flaps 3*a*, 3*b*, i.e., in areas opposite to the cut 5 in the middle area; and cuts 5, 5 which are formed by connecting right and left ends of the cut 5 in the middle area with right and left ends of the pair of creases 6, 6, with the cuts constituting the opening portion 10 being formed by using a waved blade cutting tool whose blade portion has a pitch in the range of 0.1 mm to 3.0 mm, preferably, 0.1 mm.

Next, with reference to FIG. 5 to FIG. 9, a function of the paper container 1 according to the one embodiment of the present invention will be described.

Before start of use of the paper container 1 according to the present embodiment, the pair of up and down movable, central flaps 3*a*, 3*b* for removing paper or the like P, and the pairs of side flaps 4*a*, 4*b*, and side flaps 4*c*, 4*d* are flat on the top of the container main body 2.

Figure 6:
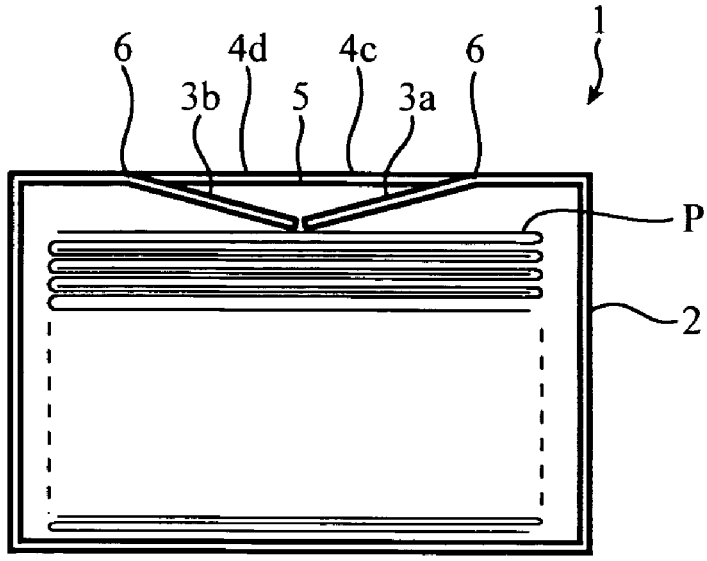
FIG. 6 is a sectional view showing a condition at a start of use of the paper container according to the embodiment of the present invention.

In order to remove paper or the like P from inside of the container main body 2, a user presses down the up and down movable flaps 3*a*, 3*b* by two fingers as shown in FIG. 6. By doing this, the up and down movable flaps 3*a*, 3*b* are folded down at creases 6, and a top layer of paper or the like P is exposed. Then the user can pinch the first paper or the like P by two fingers, for example, and remove it upward from the container main body 2.

Figure 7:
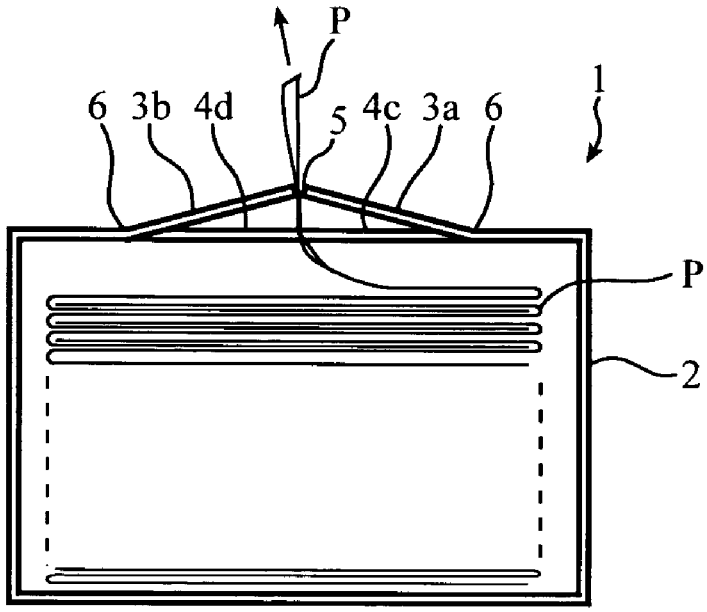
FIG. 7 is a sectional view showing a condition when a paper or the like is being removed from the paper container according to the embodiment of the present invention.
Figure 8:
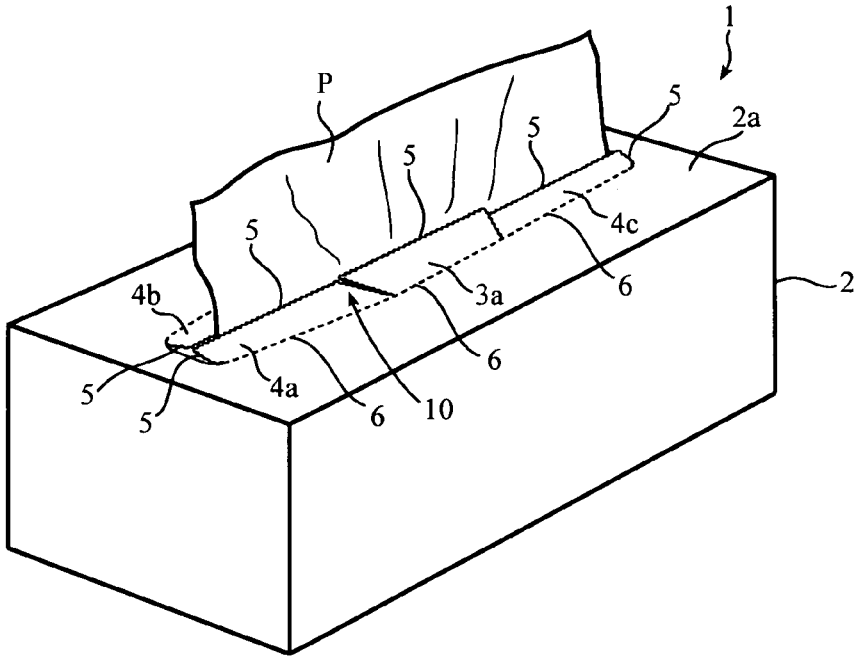
FIG. 8 is a perspective view showing a condition when the paper or the like is being removed from the paper container according to the embodiment of the present invention.

FIG. 7 and FIG. 8 show that the first paper or the like P, such as a tissue paper, is being removed upward from the container main body 2.

When paper or the like P is removed upward, the up and down movable flaps 3*a*, 3*b* which are once folded down are inverted as the paper or the like P is moved upward, and folded up at creases 6, being supported thereby, with opposed cuts 5 contacting both surfaces of the first paper or the like P.

In this case, the pairs of side flaps 4*a*, 4*b*, and side flaps 4*c*, 4*d* are also folded up, and opposed cuts 5 for these side flaps 4*a*, 4*b* and side flaps 4*c*, 4*d* are contacted with both surfaces of the first paper or the like P.

In thus taking the first paper or the like P upward from the container main body 2, the second paper or the like P, which is folded in conjunction with the first paper or the like P, is successively pulled upward, being interlocked with the first paper or the like P (this statement is also applicable to the third and subsequent papers or the like P).

Figure 9:
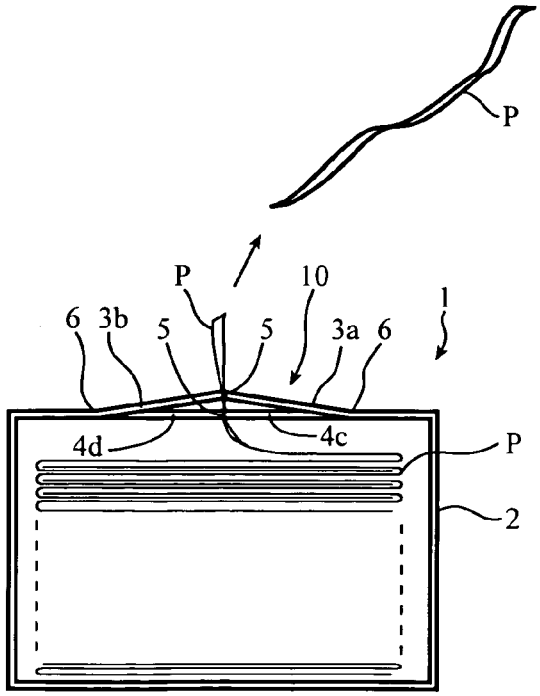
FIG. 9 is a sectional view showing a condition after a first paper or the like has been removed from the paper container according to the embodiment of the present invention.

Once the first paper or the like P is completely removed from the container main body 2, as shown in FIG. 9, a leading edge of the second paper or the like P is exposed in the opening portion 10 in the container main body 2, with the opposed cuts 5 for the up and down movable flaps 3*a*, 3*b*, the side flaps 4*a*, 4*b*, and the side flaps 4*c*, 4*d* being contacted with both surfaces of the second paper or the like P, respectively.

In other words, the up and down movable flaps 3*a*, 3*b*, the side flaps 4*a*, 4*b*, and the side flaps 4*c*, 4*d* function not only as paper holders to prevent the paper or the like P from being dropped, but also as covers to prevent dirt and dust, insects and the like from entering inside the container main body 2.

Such functions of the up and down movable flaps 3*a*, 3*b*, the side flaps 4*a*, 4*b*, and the side flaps 4*c*, 4*d* are maintained until the papers or the like P which are placed one upon another, being folded, in the container main body 2 are used one after another and finally used up.

With the paper container 1 according to the present embodiment, the respective cuts 5 for the up and down movable flaps 3*a*, 3*b*, and the side flaps 4*a*, 4*b*, 4*c*, 4*d* in the opening portion 10 are provided with a blade geometry which has a pitch of 0.1 mm to 3.0 mm, preferably, 0.1 mm, and thus, various high-performance paper containers can be provided which assure excellent operability in removing a paper or the like P, such as a tissue paper, holdability for paper or the like, and sanitation, and yet eliminate a possibility of a user's fingers being accidentally injured in removing a paper or the like, such as a tissue paper, in opening or unsealing the paper container 1, and that of the paper or the like, such as a tissue paper, being damaged when it is removed from the paper container 1.

In addition, with the paper container 1 according to the present embodiment, a need for attaching a plastic film to the opening portion as with the conventional art is eliminated, which can reduce manufacturing cost, and simplify operation of a user in disposal of the paper container 1, and yet a paper container which is environmentally-conscious can be provided.

The paper container 1 according to the present embodiment can be applied not only as a container for tissue papers, but also as that for various thin papers for packaging foods and the like.

According to the present invention as described above in detail, a high-performance paper container can be provided which can lower manufacturing cost, assure operability in removing a paper or the like, such as a tissue paper, holdability for paper or the like, and sanitation, and yet eliminate a possibility of a user's fingers being accidentally injured and that of the paper or the like being damaged.

What is claimed is:

1. A container comprising:

a main body for accommodating folded papers placed one upon another; and an opening, for allowing the papers to be removed from said main body, in a side of said main body, wherein said opening is defined by opposing corrugated edges, with each of said opposing corrugated edges including crests and valleys with a pitch between adjacent ones of said crests being within a range of from 0.1 mm to 3.0 mm.

2. The container according to claim 1, wherein said pitch between adjacent ones of said crests is 0.1 mm.

3. A container comprising:

a main body for accommodating folded papers placed one upon another; and an opening portion, for allowing the papers to be removed from said main body, on a side of said main body, wherein said opening portion includes first and second flaps having respective first and second opposing corrugated edges, with said first opposing corrugated edge including first crests and valleys with a pitch between adjacent ones of said first crests being within a range of from 0.1 mm to 3.0 mm, and with said second opposing corrugated edge edge including second crests and valleys with a pitch between adjacent ones of said second crests being within a range of from 0.1 mm to 3.0 mm.

4. The container according to claim 3, wherein said first flap comprises a first portion of said main body defined by a first crease and two first cuts extending from said first crease to said first corrugated edge, and said second flap comprises a second portion of said main body defined by a second crease and two second cuts extending from said second crease to said second corrugated edge.

5. The container according to claim 4, wherein said pitch between adjacent ones of said first crests is 0.1 mm, and said pitch between adjacent ones of said second crests is 0.1 mm.

6. The container according to claim 3, wherein said opening portion further includes (i) third and fourth flaps having respective third and fourth opposing corrugated edges, with said third opposing corrugated edge including third crests and valleys with a pitch between adjacent ones of said third crests being within a range of from 0.1 mm to 3.0 mm, and with said fourth opposing corrugated edge including fourth crests and valleys with a pitch between adjacent ones of said fourth crests being within a range of from 0.1 mm to 3.0 mm, and (ii) fifth and sixth flaps having respective fifth and sixth opposing corrugated edges, with said fifth opposing corrugated edge including fifth crests and valleys with a pitch between adjacent ones of said fifth crests being within a range of from 0.1 mm to 3.0 mm, and with said sixth opposing corrugated edge including sixth crests and valleys with a pitch between adjacent ones of said sixth crests being within a range of from 0.1 mm to 3.0 mm.

7. The container according to claim 6, wherein said third flap comprises a third portion of said main body defined by a third crease, one of said first cuts, and a third cut extending from said third crease to said third corrugated edge, with said one of said first cuts extending from said third crease to said third corrugated edge, said fourth flap comprises a fourth portion of said main body defined by a fourth crease, one of said second cuts, and a fourth cut extending from said fourth crease to said fourth corrugated edge, with said one of said second cuts extending from said fourth crease to said fourth corrugated edge, said fifth flap comprises a fifth portion of said main body defined by a fifth crease, another one of said first cuts, and a fifth cut extending from said fifth crease to said fifth corrugated edge, with said another one of said first cuts extending from said fifth crease to said fifth corrugated edge, and said sixth flap comprises a sixth portion of said main body defined by a sixth crease, another one of said second cuts, and a sixth cut extending from said sixth crease to said sixth corrugated edge, with said another one of said second cuts extending from said sixth crease to said sixth corrugated edge.

8. The container according to claim 7, wherein said two first cuts, said two second cuts, said third cut, said fourth cut, said fifth cut and said sixth cut each define opposing corrugated edges, with each of said opposing corrugated edges including additional crests and valleys, with a pitch between adjacent ones of said additional crests being within a range of from 0.1 mm to 3.0 mm.

9. The container according to claim 8, wherein said pitch between adjacent ones of said additional crests is 0.1 mm, said pitch between adjacent ones of said third crests is 0.1 mm, said pitch between adjacent ones of said fourth crests is 0.1 mm, said pitch between adjacent ones of said fifth crests is 0.1 mm, and said pitch between adjacent ones of said sixth crests is 0.1 mm.

10. A container comprising:

a container main body that is to accommodate a number of folded papers that are placed one upon another; and an opening portion for removal of the papers, said opening portion being on a side of said container main body, and said opening portion including a pair of up and down movable central flaps and pairs of side flaps on both sides of said up and down movable central flaps, with a cut existing between said up and down movable central flaps, between said side flaps of each said pair of side flaps, between each said up and down movable central flap and corresponding ones of said side flaps, and between a side edge of each said side flap and an upper face forming said side of said container main body, and with a crease existing at respective rear ends of said pair of up and down movable central flaps and said pairs of side flaps.

11. The container according to claim 10, wherein each said cut is formed with a waved blade cutting tool including a blade portion having a pitch of 0.1 mm to 3.0 mm.

12. The container according to claim 11, wherein said opening portion is on a top side of said main body.

13. The container according to claim 12, wherein said container main body is in the form of a rectangular parallelepiped.

14. The container according to claim 13, wherein said opening portion is generally rectangular in shape.

15. The container according to claim 14, wherein said pairs of side flaps are symmetrically positioned on both sides of said up and down movable central flaps.

16. The container according to claim 10, wherein each said cut is formed with a waved blade cutting tool including a blade portion having a pitch of 0.1 mm.

17. The container according to claim 16, wherein said opening portion is on a top side of said main body.

18. The container according to claim 17, wherein said container main body is in the form of a rectangular parallelepiped.

19. The container according to claim 18, wherein said opening portion is generally rectangular in shape.

20. The container according to claim 19, wherein said pairs of side flaps are symmetrically positioned on both sides of said up and down movable central flaps.

* * * * *